US006616136B1

(12) United States Patent
Huang et al.

(10) Patent No.: US 6,616,136 B1
(45) Date of Patent: Sep. 9, 2003

(54) FRICTION PLATE COUPLING STRUCTURE

(75) Inventors: Yin-Chun Huang, Hsinchu (TW); Pi-Chun Chen, Changhua Hsien (TW); Ji-Mei Tsuei, Hsinchu (TW)

(73) Assignee: UMAX Data Systems, Inc., Hsinchu (TW)

( * ) Notice: Subject to any disclaimer, the term of this patent is extended or adjusted under 35 U.S.C. 154(b) by 0 days.

(21) Appl. No.: 10/063,740

(22) Filed: May 9, 2002

(51) Int. Cl.[7] ..... B65H 5/06

(52) U.S. Cl. ..... 271/10.13; 271/109; 271/314; 271/272; 271/264

(58) Field of Search ..... 271/314, 109, 271/272, 264, 10.13; 74/322, 125.5, 361, 349; 192/66.2, 66.22, 76.15

(56) References Cited

U.S. PATENT DOCUMENTS

| | | | | | |
|---|---|---|---|---|---|
| 1,657,265 | A | * | 1/1928 | Ludiwg | 192/66.2 |
| 2,070,154 | A | * | 2/1937 | Carter | 192/53.6 |
| 4,212,379 | A | * | 7/1980 | Zoino | 192/52.3 |
| 5,265,859 | A | * | 11/1993 | Watson et al. | 271/109 |
| 5,624,109 | A | * | 4/1997 | Tanaka | 271/10.13 |
| 6,076,644 | A | * | 6/2000 | Forrest et al. | 192/66.2 |
| 6,168,147 | B1 | * | 1/2001 | Nose et al. | 271/10.13 |

* cited by examiner

*Primary Examiner*—Donald P. Walsh
*Assistant Examiner*—Kaitlin Joerger
(74) *Attorney, Agent, or Firm*—Jianq Chyun IP Office

(57) ABSTRACT

A friction plate coupling structure inside an automatic document feeder. The friction contact surface of the friction plates is designed to have a slant surface resembling a frustum so that overall contact area is increased and stability of the coupling between the friction plates is improved.

20 Claims, 12 Drawing Sheets

FRICTION PLATE COUPLING STRUCTURE

BACKGROUND OF THE INVENTION

1. Field of Invention

The present invention relates to a friction plate coupling structure. More particularly, the present invention relates to the friction plate coupling structure of an automatic document feeder.

2. Description of Related Art

Due to the rapid development of image input, processing and amending equipment, a scanner has become an indispensable peripheral device for a computer system. The scanner is capable of scanning text or image data from documents, journals, books and pictures and feeding the data into a computer for further treatment.

Among scanners, a platform scanner is the most common type. Inside a platform scanner, the scanning module shuttles forward and backward underneath a transparent platform so that a document placed on top of the transparent panel can be scanned. The scanning module has no driving power of its own and hence has to be driven by an external driving system that includes a stepper motor, a set of gears and a transmission belt. Before scanning, the document is placed atop the transparent platform and a document cover is lowered to flatten out the document on the transparent platform.

However, when the number of documents that needs to be scanned is considerable, using a simple platform type scanner to scan the documents is quite cumbersome and time-consuming. To simplify and speed up the scanning operation, an automatic document feeder (ADF) is often attached to the platform scanner. The automatic document feeder is a simple delivering device that transfers each document in a pile onto the platform sequentially for scanning.

FIG. 1 is a schematic side view of a conventional platform type scanner with an automatic document feeder thereon. As shown in FIG. 1, an automatic document feeder 100 sits atop the platform scanner 200. FIG. 2 is a perspective view showing some internal components of the automatic document feeder in FIG. 1. The automatic document feeder 300 mainly comprises a body casing 310, two rollers 320, 322, a gearset 330, a shaft 340, two friction plates 350, 352 and a torsion spring 360. FIG. 3 is a magnified view of area 3 of the automatic document feeder as shown in FIG. 2.

The shaft 340 is attached to the upper rear side of the body of a movable cover 110 of the automatic document feeder 100. The shaft 340 may rotate around a central axis when driven by a driving mechanism (not shown). The shaft is attached to the body casing 310 via a bearing so that the shaft 340 may rotate without affecting the casing 310. The rollers 320, 322 and the gearset 330 are also attached to the interior of the body casing 310. The roller 320 is joined to the shaft 340. The axis of both the roller 320 and the shaft 340 are concentric and the roller 320 can be driven into rotation through the shaft 340. The roller 322 is attached to the body casing 310 through a pair of bearings and hence is capable of rotating. The axis of the roller 322 is parallel to the axis of the roller 320. The gearset is set up between the shaft 340 and the roller 322 so that the roller 322 is able to rotate in an identical direction as the shaft 340 when driven by the shaft 340.

The two friction plates 350, 352 and the torsion spring 360 are set up on the shaft 340 on the left side of the roller

320 inside the body casing 310. The friction plate 350 has a tubular sleeve profile tightly engaged to the shaft 340. The friction plate 350 rotates together with the shaft 340. The friction plate 352 also has a tubular sleeve profile and slides movably (indirectly) over the shaft 340. Hence, the friction plate 352 is only indirectly driven by the shaft 340. The torsion spring 360 is clamped between the friction plate 352 and the body casing 310. One end 362 of the torsion spring 360 is fastened to the body casing 310 while the other end is fastened to the friction plate 352. Through a compression of the torsion spring 360, the friction plate 352 is pushed to the right pressing against the friction plate 350. Utilizing frictional force between the two friction plates 350 and 352, a rotation of the friction plate 350 drives the friction plate 351 and twists the torsion spring 360 as well. Consequently, the body casing 310 also rotates relative to the central axis of the shaft 340.

FIG. 4 is a front view showing the relative positioning of the shaft 340, the body casing 310, the torsion spring 360, the friction plates 350, 352 and the gearset 330 inside an automatic document feeder 300.

The following is a brief description of the action taken by a paper feed unit to bring a document into the platform scanner. FIG. 5 is a schematic side view showing the configuration of a paper feed unit poised for bringing a document into the scanner. As shown in FIG. 5, one end of the paper feeding assembly 300 is lifted up through a tension spring 370 so that the roller 320 remains in suspension without touching any scan document 400. When power to the automatic document feeder 100 is turned on, the paper feed unit 300 takes action. Driven by a driving device, the shaft 340 rotates (rotates in a clockwise direction in the figure) and drives the rollers 320 and 322 in the same direction rotation. Subjected to the driving force provided by the shaft 340, the friction plate 350 also rotates. The rotation of the friction plate 350 causes both the friction plate 352 and the torsion spring 360 to turn due to friction. Since one end 362 of the torsion spring 360 is fastened to the body casing 310, a torque is provided by the torsion spring 360 to turn the entire paper feed unit 300 relative to the central axis of the shaft 340 (clockwise rotation in the figure). Hence, the uplifting force provided by the spring 370 is canceled out. FIG. 6 is a schematic side view showing the configuration of a paper feed unit 300 after lowering the roller 322 onto the document 400. With the paper feed unit 300 lowered, documents 400 are transferred into the optical scanner 200 through the automatic document feeder 100 one by one.

FIG. 7 is a schematic side view showing the external profile of the friction plates 350 and 352. As shown in FIG. 7, both friction plates 350 and 352 have a circular shape with a hollow tubular center. The tubular sleeve profile permits the friction plate 350 to slide into the shaft 340 while the tubular sleeve profile permits the friction plate 352 to slide into outer bossing of the friction plate 350 (that is, the friction plate 352 slides into the shaft 340 only indirectly). The frictional contact surfaces between the friction plates 350 and 352 include the vertical surfaces 3501, 3521 along the radial direction and the circular surfaces 3502, 3522 parallel to the axial direction.

When the friction plate 350 slides into the friction plate 352, tolerance between the two has considerable effect on the ultimate area involved in frictional contact. In general, tolerance between axial diameter of the friction plate 350 and hole diameter of the friction plate 352 is rather loose due to the cost of producing a tight fit. A loose fitting between the friction plates 350 and 352 often leads to coupling problems such as the one shown in FIG. 8. FIG. 8 is a diagram of a portion of the paper feed unit showing the friction plate 352 having a slant face relative to the straight face of the friction plate 350 due to an unevenly distributed pressure exerted by the torsion spring 360. FIG. 9 is a magnified cross-sectional view of the friction plates 350 and 352 engaged directly and indirectly to the shaft 340 as shown in FIG. 8. FIG. 10 also shows one other form of distortion between the friction plates 352 and 350 due to the presence of a gap between the hole in the friction plate 352 and the axle in the friction plate 350. FIG. 11 is a magnified cross-sectional view of the friction plates 350 and 352 engaged directly and indirectly to the shaft 340 as shown in FIG. 10. Without the engagement of all frictional contact areas, transmission capacity of the paper feed unit 300 may be compromised.

SUMMARY OF THE INVENTION

Accordingly, one object of the present invention is to provide a structure for coupling a pair of friction plates. Instead of having a perpendicular surface in the radial direction as in a conventional design, both friction plates have a slant surface sloping at an angle similar to the surface of a truncated cone or a frustum. Consequently, frictional contact areas between the coupling friction plates are stabilized and engagement between the friction plates is improved.

To achieve these and other advantages and in accordance with the purpose of the invention, as embodied and broadly described herein, the invention provides a friction plate coupling structure. The structure includes a transmission shaft, a first friction plate and a second friction plate.

The first friction plate has a tubular sleeve structure tightly fitted into the transmission shaft. Hence, the transmission shaft is able to drive the first friction plate into rotary motion. The first friction plate has a first friction surface similar in form to the slant surface of a frustum oriented along the axis of the first friction plate.

The second friction plate also has a tubular sleeve structure capable of sliding over the first friction plate or the transmission shaft. The second friction plate has a second friction surface with a surface that matches the frustum-shaped first friction surface. The second friction surface and the first friction surface are in close contact with each other.

The frictional contact surface may have a roughened surface for higher friction. The friction contact surface may be roughened through the formation of patterned micro-studs or patterned ridges. Alternatively, mylar sheet with a roughened surface may be attached to various friction contact surfaces.

One major aspect of this invention is the introduction of a frustum-shaped contact area between the coupling friction plates. Hence, not only is the contact surface area between the friction plates increased, but coupling stability between the friction plates is also improved. Consequently, adverse effects due to a loose fit between a shaft and an axial hole are largely removed.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1:
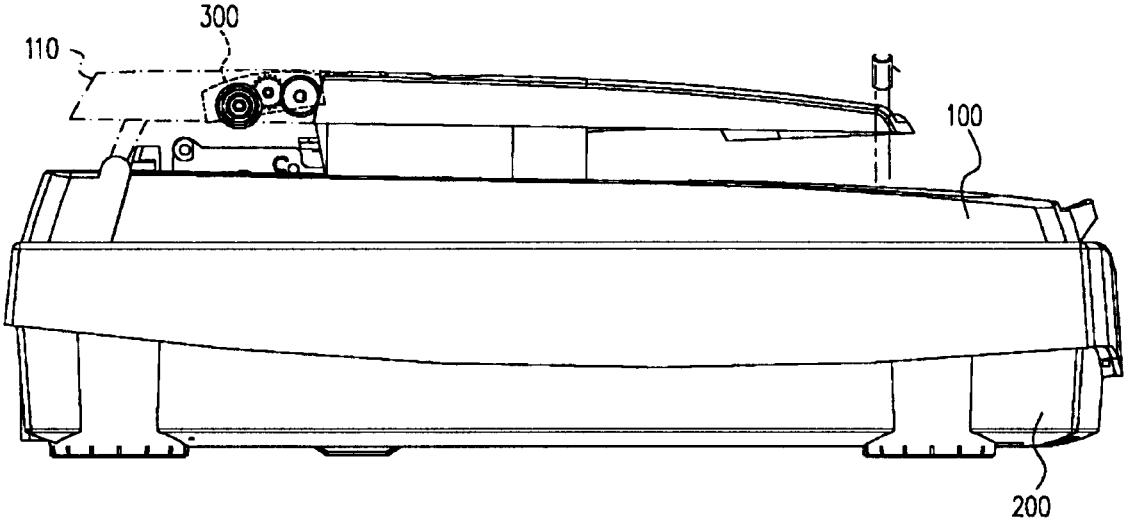
FIG. 1 (PRIOR ART)
FIG. 1 is a schematic side view of a conventional platform type scanner with an automatic document feeder thereon.
Figure 2:
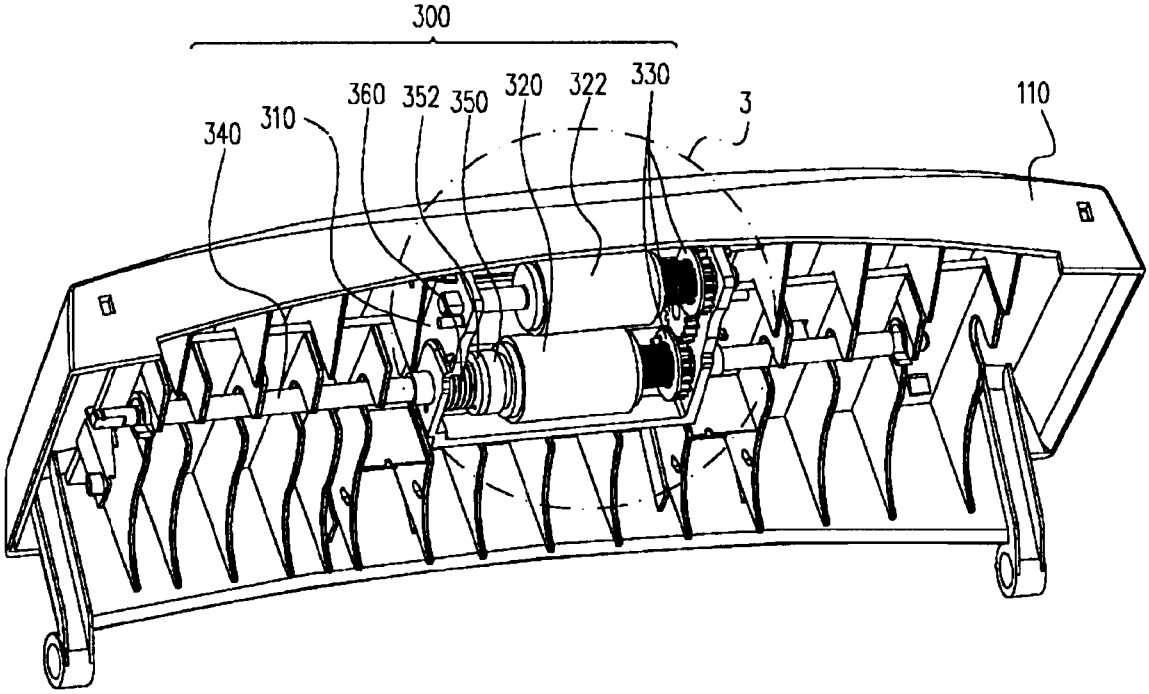
FIG. 2 (PRIOR ART)
FIG. 2 is a perspective view showing some internal components of the automatic document feeder in FIG. 1.
Figure 3:
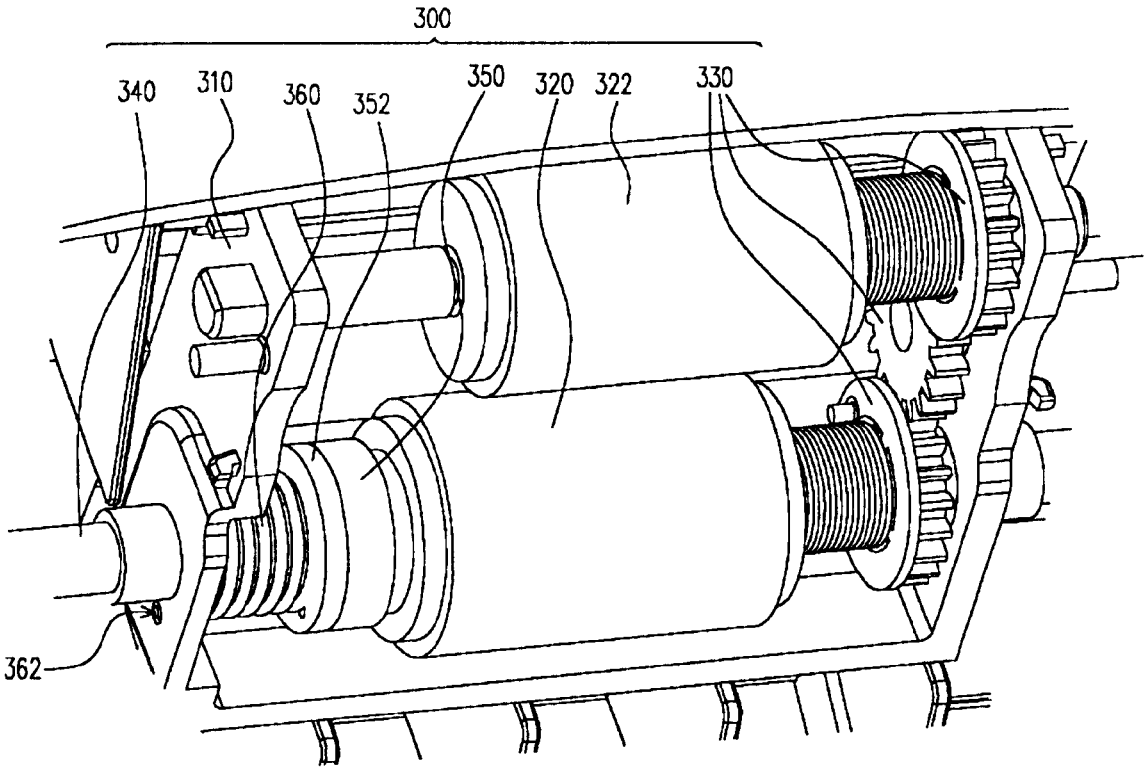
FIG. 3 (PRIOR ART)
FIG. 3 is a magnified view of area 3 of the automatic document feeder as shown in FIG. 2.
Figure 4:
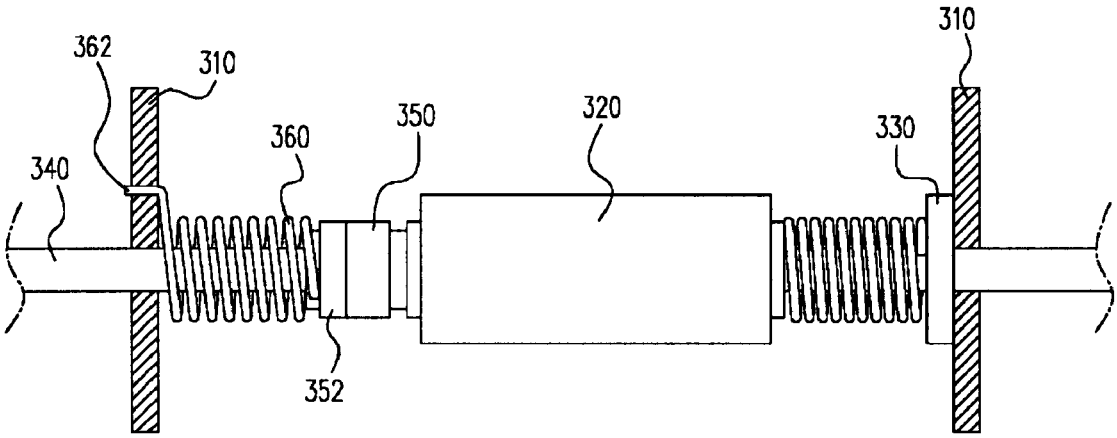
FIG. 4 (PRIOR ART)
FIG. 4 is a front view showing the relative positioning of a shaft, a body casing, a torsion spring, a pair of friction plates and a gearset inside a conventional automatic document feeder.
Figure 5:
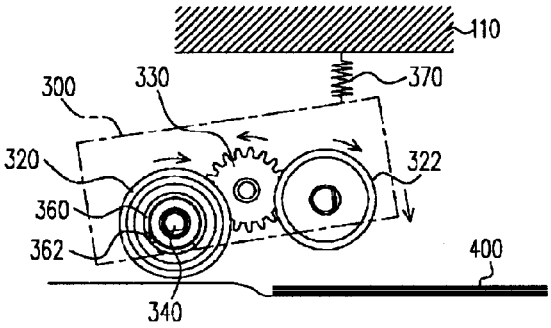
FIG. 5 (PRIOR ART)
FIG. 5 is a schematic side view showing the configuration of a conventional paper feed unit poised for bringing a document into the scanner.
Figure 6:
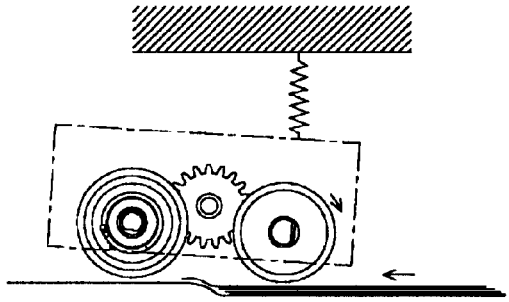
FIG. 6 (PRIOR ART)
FIG. 6 is a schematic side view showing the configuration of a conventional paper feed unit after lowering the roller onto the document.
Figure 7:
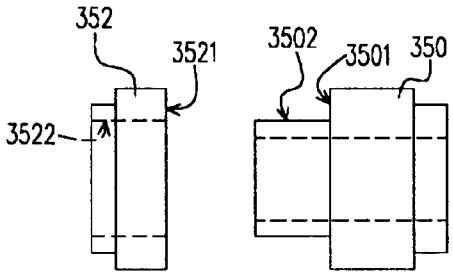
FIG. 7 (PRIOR ART)
FIG. 7 is a schematic side view showing the external profile of a pair of conventional friction plates.
Figure 8:
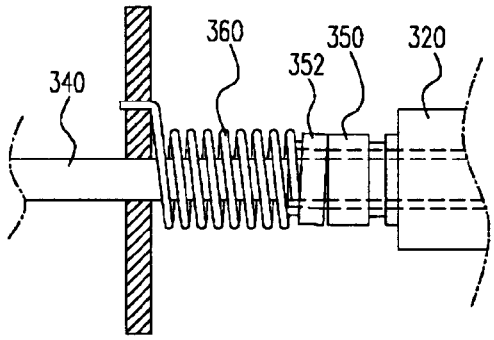
FIG. 8 (PRIOR ART)
FIG. 8 is a diagram of a portion of a conventional paper feed unit showing a friction plate having a slant face relative to the straight face of another friction plate due to an unevenly distributed pressure exerted by a torsion spring.
Figure 9:
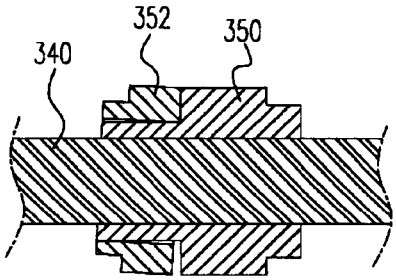
FIG. 9 (PRIOR ART)
FIG. 9 is a magnified cross-sectional view of the friction plates engaged directly and indirectly to the shaft as shown in FIG. 8.
Figure 10:
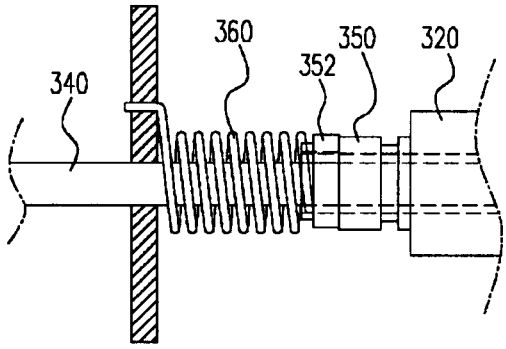
FIG. 10(PRIOR ART)
FIG. 10 shows one other form of distortion between the friction plates due to the presence of a gap between the hole in a first friction plate and the axle in a second friction plate.
Figure 11:
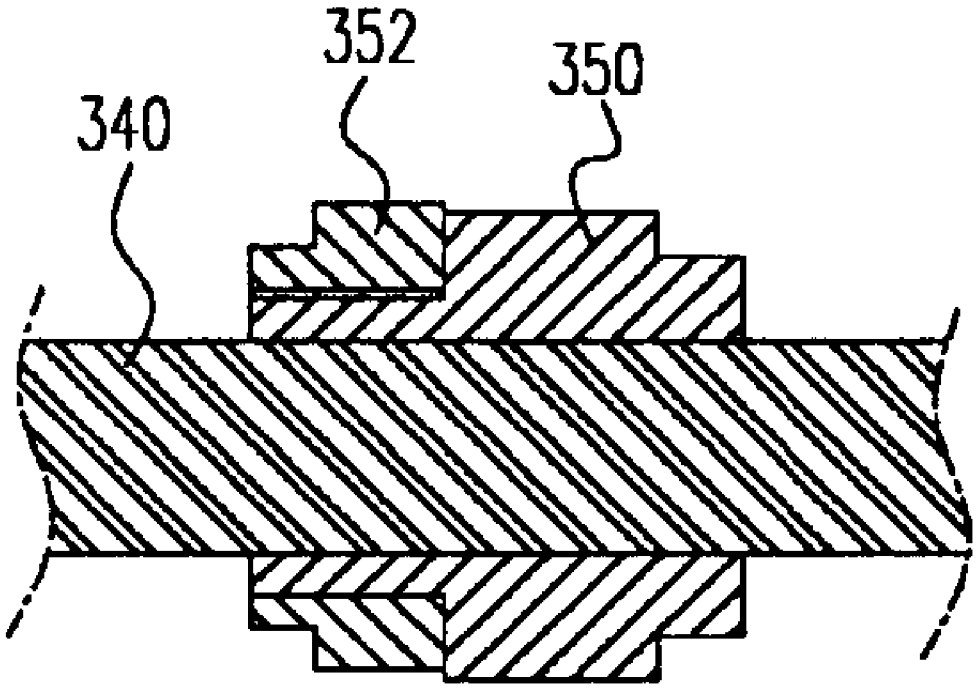
FIG. 11(PRIOR ART)
FIG. 11 is a magnified cross-sectional view of the friction plates engaged directly and indirectly to the shaft as shown in FIG. 10.

Reference will now be made in detail to the present preferred embodiments of the invention, examples of which are illustrated in the accompanying drawings. Wherever possible, the same reference numbers are used in the drawings and the description to refer to the same or like parts.

Figure 12:
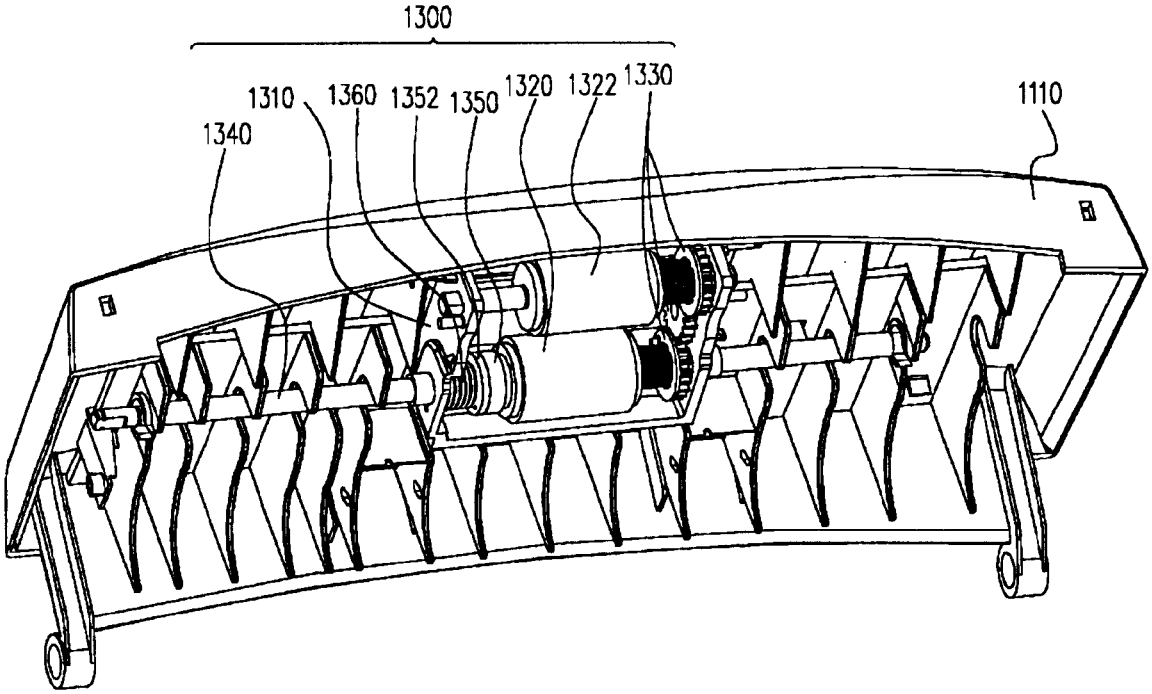
FIG. 12 is a perspective view showing some internal components inside the automatic document feeder according to the embodiment of this invention.

FIG. 12 is a perspective view showing some internal components inside the automatic document feeder according to the embodiment of this invention. As shown in FIG. 12, the document feed unit 1300 includes a body casing 1310, a pair of rollers 1320, 1322, a set of gears 1330, a transmission shaft 1340, a pair of friction plates 1350, 1352 and a torsion spring 1360.

The transmission shaft 1340 is fixed inside the main body 1110 of the automatic document feeder. The transmission shaft 1340 is driven by a driver setup (not shown) so that the shaft may rotate around its axis.

The transmission shaft 1340 mounts on the body casing 1310 through a bearing. Hence, the body casing is capable of rotating relative to the axis of the shaft 1340 but not driven by the shaft 1340.

The rollers 1320, 1322 and the gearset 1330 are housed inside the body casing 1310. The roller 1320 is fixed onto the shaft 1340. The axis of both the roller 1320 and the shaft 1340 are concentric. Since the roller 1320 mounts tightly onto the shaft 1340, the roller 1320 is driven when the shaft 1340 rotates. The roller 1322 also attaches to the body casing 1310 but is free to rotate relative to the casing 1310. The axis of the roller 1322 is parallel to the axis of the roller 1320. The gearset 1330 is set up between the transmission shaft 1340 and the roller 1322. Consequently, the roller 1322 rotates in the same direction as the shaft 1340 when the shaft 1340 is driven.

The first friction plate 1350, the second friction plate 1352 and the torsion spring 1360 are also set up inside the body casing 1310 mounted over the shaft 1340 on the left side of the roller 1320. The first friction plate 1350 has a tubular sleeve structure fixed on the shaft 1340 and driven by the shaft 1340. The second friction plate 1352 also has a tubular sleeve structure. The second friction plate 1352 slides loosely into the shaft 1340 and hence is free to rotate relative to the shaft 1340. The second friction plate 1352 couples with the first friction plate 1350 through a common contact surface.

The torsion spring 1360 is clamped between the second friction plate 1352 and the body casing 1310. One end 1362 of the torsion spring 1360 is fastened to the body casing 1310 while the other end is fastened to the second friction plate 1352. The torsion spring 1360 is further slightly compressed to provide a pressure on the second friction plate 1352 so that the second friction plate 1352 is pressed against the first friction plate 1350. Through frictional coupling between the two friction plates 1350 and 1352, the second friction plate 1352 and the torsion spring 1360 are twisted when the first friction plate 1350 rotates. The rotation of the second friction plate 1352 also brings about a rotation of the body casing 1310 around the axis of the transmission shaft 1340.

Before the document feed unit 1300 takes action, a lifting force provided by an extension spring (not shown) close to the second roller 1320 lifts up the document feed unit 1300 so that the second roller 1320 is suspended in mid-air.

Figure 13:
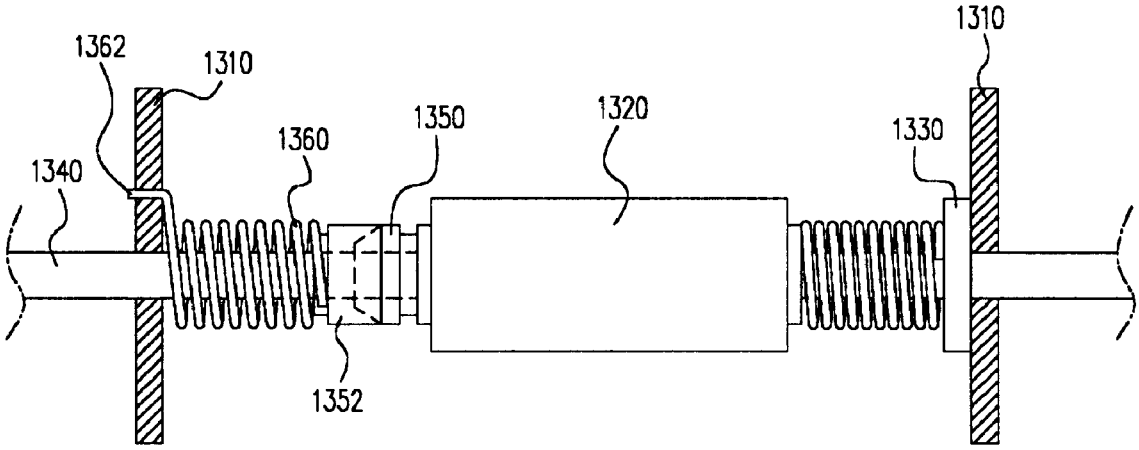
FIG. 13 is a front view showing the relative positioning of a shaft, a body casing, a torsion spring, a pair of friction plates and a gearset inside an automatic document feeder according to the embodiment of this invention.

FIG. 13 is a front view showing the relative positioning of the shaft 1340, the body casing 1310, the torsion spring 1360, the friction plates 1350, 1352 and the gearset 1330 inside the automatic document feeder according to the embodiment of this invention.

Figure 14:
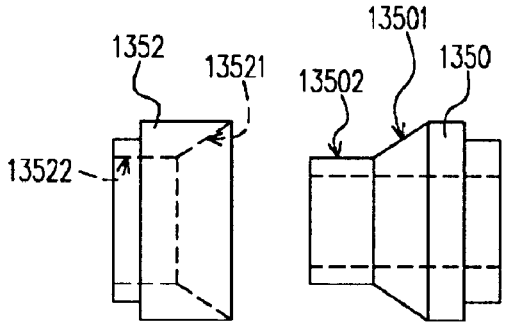
FIG. 14 is a schematic side view showing the external profile of a pair of friction plates according to the embodiment of this invention.
Figure 15:
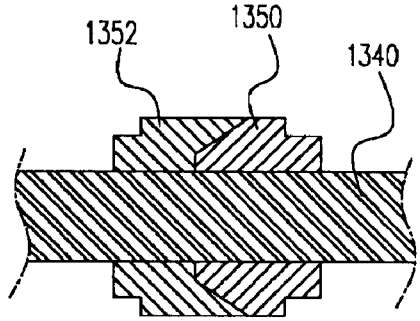
FIG. 15 is a cross-sectional view of the friction plates engaged directly and indirectly to the shaft as shown in FIG. 13.

FIG. 14 is a schematic side view showing the external profile of a pair of friction plates according to the embodiment of this invention. To prevent mismatch between the axial diameter and the hole diameter of the first friction plate 1350 and the second friction plate 1352 due to manufacturing tolerance, opposing frustum-shaped surfaces 13501 and 13521 are introduced in this invention aside from the friction surfaces 13522 and 13502 along the axial direction. The friction contact surface 13521 is formed inside the second friction plate 1352 on the slanting surface of a frustum with its axis oriented along the axial direction. The friction contact surface 13501 is formed outside the first friction plate 1350 on the slanting surface of a similar shaped frustum with its axis oriented along the axial direction. The recess frustum-shaped cavity of the second friction plate 1352 accommodates the frustum-shaped protrusion on the first friction plate 1350 so that the friction contact surfaces 13501 and 13521 may form a close frictional contact with each other. FIG. 15 is a cross-sectional view of the friction plates 1350, 1352 engaged directly and indirectly to the shaft 1340.

By forming a frustum-shaped surface in the first and the second friction plates 1350, 1352, overall surface area for frictional contact such as the friction contact surfaces 13501 and 13521 is increased. Furthermore, the stability of the coupling friction plates 1350 and 1352 also improves because the effect of a loose fit between shaft and hole is greatly reduced.

In addition, the friction contact surfaces including 13501, 13521, 13522 and 13502 may be roughened to increase friction. The surfaces may be roughened, for example, by etching out patterned protruding studs or ridges. Alternatively, surface roughened mylar sheet may be attached to the friction surface.

In the aforementioned description, the torsion spring 1360 is fastened to the second friction late 1352. However, location of the first friction plate 1350 and the second friction plate 1352 may be interchanged so that the torsion spring 1360 may fasten to the first friction plate 1350 instead.

Figure 16:
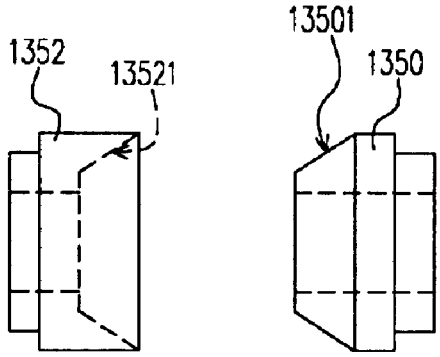
FIG. 16 is a schematic side view showing the external profile of a pair of friction plates according to an alternative embodiment of this invention.
Figure 17:
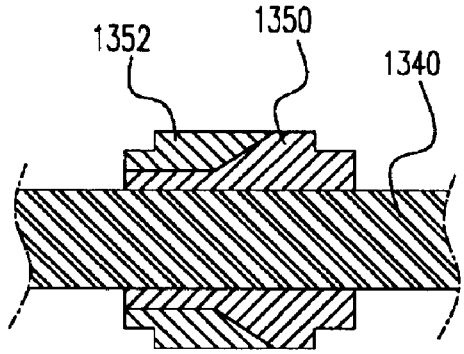
FIG. 17 is a cross-sectional view of the friction plates engaged directly and indirectly to the shaft as shown in FIG. 16.

FIG. 16 is a schematic side view showing the external profile of a pair of friction plates according to an alternative embodiment of this invention. As shown in FIG. 16, the friction contact surfaces 13522 and 13502 along the axial direction between the first friction plate 1350 and the second friction plate 1352 are deleted. Hence, only the friction contact areas 13501 and 13521 shaped out of a frustum are retained. Despite such deletion, the friction plate structures are still capable of forming a stable coupling between the first friction plate 1350 and the second friction plate 1352 and lowering the effect of shaft/hole tolerance. FIG. 17 is a cross-sectional view of the friction plates 1350, 1352 engaged directly and indirectly to the shaft 1340.

Similarly, the friction contact surfaces 13501 and 13521 may be roughened to increase friction. The surfaces may be roughened, for example, by etching out patterned protruding studs or ridges. Alternatively, surface roughened mylar sheet may be attached to the friction surface. In addition, location of the first friction plate 1350 and the second friction plate 1352 may also be interchanged so that the torsion spring 1360 may fasten to the first friction plate 1350 instead.

In conclusion, a friction plate having a frustum-shaped friction contact area is provided so that the coupling between friction plates is stabilized and the effect on engagement due to a loose fit between hole-shaft tolerance is reduced. Hence, one major aspect of this invention is the introduction of a frustum-shaped contact area between the coupling friction plates. Not only is the contact surface area between the friction plates increased, but coupling stability between the friction plates is also improved. Finally, adverse effects due to a loose fit between a shaft and an axial hole are largely removed.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A structure for coupling a pair of friction plates to drive a body of a paper feed unit, comprising:

a transmission shaft;

a first friction plate having a tubular sleeve structure, wherein the first friction plate slips into and firmly adheres to the transmission shaft so that the first friction plate rotates when the shaft rotates, the first friction plate further includes a first friction surface shaped like the slanting surface of a frustum and oriented along the axis of the first friction plate; and a second friction plate having a tubular sleeve structure freely coupled to the first friction plate, wherein the second friction plate further includes a second friction surface having a shape that matches the frustum-like first friction surface in shape so that the second friction surface may form a close contact with the first friction surface, wherein the second friction plate is coupled to the body, whereby when the first friction plate is rotated by the transmission shaft, the body is rotated also due to the first friction plate being contact with the second friction plate.

2. The friction plate coupling structure of claim 1, wherein both the first friction plate and the second friction plate have a roughened surface.

3. The friction plate coupling structure of claim 1, wherein the surface of the first friction plate and the second friction plate includes a plurality of protruding studs.

4. The friction plate coupling structure of claim 1, wherein the surface of the first friction plate and the second friction plate includes a plurality of protruding ridges.

5. A coupling structure for a pair of friction plates to drive a body, comprising:

a transmission shaft;

a first friction plate having a tubular sleeve structure, wherein the first friction plate slips into and firmly adheres to the transmission shaft so that the first friction plate rotates when the shaft rotates, the first friction plate further includes a first friction surface shaped like the slanting surface of a frustum and oriented along the axis of the first friction plate; and a second friction plate having a tubular sleeve structure freely coupled to the transmission shaft, wherein the second friction plate further includes a second friction surface having a shape that corresponds in shape to the frustum-like first friction surface so that the second friction surface may form a close contact with the first friction surface, wherein the second friction plate is coupled to the body, whereby when the first friction plate is rotated by the transmission shaft, the body is rotated also due to the first friction plate being contact with the second friction plate.

6. The friction plate coupling structure of claim 5, wherein both the first friction plate and the second friction plate have a roughened surface.

7. The friction plate coupling structure of claim 6, wherein the surface of the first friction plate and the second friction plate includes a plurality of protruding studs.

8. The friction plate coupling structure of claim 6, wherein the surface of the first friction plate and the second friction plate includes a plurality of protruding ridges.

9. A paper feed unit for transferring a document into an automatic document feeder, wherein the automatic document feeder has a main body and a driving system, comprising:

a transmission shaft inside the main body, wherein the transmission shaft is connected to the driving system so that the transmission shaft rotates when driven by the driving system;

a body casing slid freely over the transmission shaft;

a first roller inside the body casing and slid tightly over the transmission shaft;

a second roller inside the body casing, wherein the second roller is freely attached to the body casing and has an axis parallel to the axis of the transmission shaft;

a gearset inside the body casing for linking up the transmission shaft and the second roller;

a torsion spring slid over the transmission shaft, wherein one end of the torsion spring is fastened to the body casing;

a first friction plate having a tubular sleeve structure, wherein the first friction plate slips into and firmly adheres to the transmission shaft so that the first friction plate rotates when the shaft rotates, the first friction plate further includes a first friction surface shaped like the slanting surface of a frustum and oriented along the axis of the first friction plate; and a second friction plate having a tubular sleeve structure freely coupled to the first friction plate, wherein the other end of the torsion spring is fastened to the second friction plate so that the torsion spring is clamped between the body casing and the second friction plate to store up some elastic energy, and the second friction plate further includes a second friction surface having a shape that matches the frustum-like first friction surface in shape so that the second friction surface may form a close contact with the first friction surface.

10. The paper feed unit of claim 9, wherein both the first friction plate and the second friction plate have a roughened surface.

11. The paper feed unit of claim 10, wherein the surface of the first friction plate and the second friction plate includes a plurality of protruding studs.

12. The paper feed unit of claim 10, wherein the surface of the first friction plate and the second friction plate includes a plurality of protruding ridges.

13. The paper feed unit of claim 9, wherein the unit further includes an extension spring with one end fastened to the main body and the other end fastened to the side of the body casing close to the second roller.

14. A paper feed unit for transferring a document into an automatic document feeder, wherein the automatic document feeder has a main body and a driving system, comprising:

a transmission shaft inside the main body, wherein the transmission shaft is connected to the driving system so that the transmission shaft rotates when driven by the driving system;

a body casing slid freely over the transmission shaft;

a first roller inside the body casing and slid tightly over the transmission shaft;

a second roller inside the body casing, wherein the second roller is freely attached to the body casing and has an axis parallel to the axis of the transmission shaft;

a gearset inside the body casing for linking up the transmission shaft and the second roller;

a torsion spring slid over the transmission shaft, wherein one end of the torsion spring is fastened to the body casing;

a first friction plate having a tubular sleeve structure, wherein the first friction plate slips into and firmly adheres to the transmission shaft so that the first friction plate rotates when the shaft rotates, the first friction plate further includes a first friction surface shaped like the slanting surface of a frustum and oriented along the axis of the first friction plate; and a second friction plate having a tubular sleeve structure freely coupled to the transmission shaft, wherein the other end of the torsion spring is fastened to the second friction plate so that the torsion spring is clamped between the body casing and the second friction plate to store up some elastic energy, and the second friction plate further includes a second friction surface having a shape that matches the frustum-like first friction surface in shape so that the second friction surface may form a close contact with the first friction surface.

15. The paper feed unit of claim 14, wherein both the first friction plate and the second friction plate have a roughened surface.

16. The paper feed unit of claim 15, wherein the surface of the first friction plate and the second friction plate includes a plurality of protruding studs.

17. The paper feed unit of claim 15, wherein the surface of the first friction plate and the second friction plate includes a plurality of protruding ridges.

18. The paper feed unit of claim 14, wherein the unit further includes an extension spring with one end fastened to the main body and the other end fastened to the side of the body casing close to the second roller.

19. The structure of claim 1, further comprising a torsion spring coupled to the second friction plate and the body, whereby the torsion spring produces a spring force to increase a contact effect between the first friction plate and the second friction plate.

20. The structure of claim 5, further comprising a torsion spring coupled to the second friction plate and the body, whereby the torsion spring produces a spring force to increase a contact effect between the first friction plate and the second friction plate.

* * * * *